US010743598B2

(12) United States Patent
Harris

(10) Patent No.: US 10,743,598 B2
(45) Date of Patent: Aug. 18, 2020

(54) METHOD AND APPARATUS FOR ATTACHING HAIR EXTENSIONS TO HUMAN HAIR

(71) Applicant: Jessica Harris, Los Banos, CA (US)

(72) Inventor: Jessica Harris, Los Banos, CA (US)

( * ) Notice: Subject to any disclaimer, the term of this patent is extended or adjusted under 35 U.S.C. 154(b) by 94 days.

(21) Appl. No.: 15/854,678

(22) Filed: Dec. 26, 2017

(65) Prior Publication Data

US 2018/0116324 A1 May 3, 2018

Related U.S. Application Data

(63) Continuation-in-part of application No. 14/333,256, filed on Jul. 16, 2014, now Pat. No. 9,848,661.

(60) Provisional application No. 61/847,330, filed on Jul. 17, 2013.

(51) Int. Cl.
*A41G 3/00* (2006.01)
*A41G 5/00* (2006.01)

(52) U.S. Cl.
CPC ..... *A41G 5/0086* (2013.01); *A41G 5/0066* (2013.01); *A41G 5/0073* (2013.01)

(58) Field of Classification Search
CPC .. A41G 5/0026; A41G 5/0053; A41G 5/0066; A41G 5/0073; A41G 5/0086; A61B 17/068; B25C 5/00; B25C 5/02; B25C 5/0285
See application file for complete search history.

(56) References Cited

U.S. PATENT DOCUMENTS

| | | | |
|---|---|---|---|
| 4,372,316 | A | 2/1983 | Blake et al. |
| 4,915,100 | A | 4/1990 | Green |
| 5,004,142 | A | 4/1991 | Olesen |
| 5,516,025 | A | 5/1996 | Eriksson |
| 5,769,100 | A | 6/1998 | Alexander |
| 5,894,846 | A | 4/1999 | Gang |
| 6,135,124 | A | 10/2000 | Grant |
| 6,279,303 | B2 | 8/2001 | Sloan |
| D507,849 | S | 7/2005 | Lee |

(Continued)

OTHER PUBLICATIONS

Harris, Office Action, U.S. Appl. No. 14/333,256, dated Jan. 23, 2015, 13 pgs.

(Continued)

*Primary Examiner* — Rachel R Steitz
(74) *Attorney, Agent, or Firm* — Morgan, Lewis & Bockius LLP

(57) ABSTRACT

A handheld tool attaches hair extensions. The tool has two hand members. The members are mechanically coupled to each other and moveable with respect to each other. The tool includes a fastening mechanism. The fastening mechanism is configured to crimp a pliable material to form a fastener that attaches the hair extension to the recipient's hair. The tool includes a shield mechanism, which is coupled to one hand member. The shield mechanism includes safety feet having first and second positions. The shield mechanism is in the first position when the apparatus is in a quiescent position, and the shield mechanism is in a second position when the fastening mechanism is crimping the fastener. In the second position, the feet are interposed between the recipient's scalp and a cornrow of the recipient's hair. The safety feet move from the first position to the second position as the fastener is being crimped.

7 Claims, 18 Drawing Sheets

(56) References Cited

U.S. PATENT DOCUMENTS

| | | | | |
|---|---|---|---|---|
| D542,970 | S | 5/2007 | Park | |
| 7,621,433 | B2 * | 11/2009 | Ivarsson | B25C 5/0207 227/134 |
| 2004/0011372 | A1 | 1/2004 | Park | |
| 2005/0247326 | A1 | 11/2005 | Park | |
| 2007/0261708 | A1 | 11/2007 | Makino et al. | |
| 2013/0048006 | A1 | 2/2013 | Springfield-Thomas | |

OTHER PUBLICATIONS

Harris, Final Office Action, U.S. Appl. No. 14/333,256, dated May 23, 2015, 11 pgs.
Harris, Office Action, U.S. Appl. No. 14/333,256, dated Dec. 6, 2016, 8 pgs.
Harris, Final Office Action, U.S. Appl. No. 14/333,256, dated May 5, 2017, 7 pgs.
Harris, Notice of Allowance, U.S. Appl. No. 14/333,256, dated Aug. 22, 2017, 5 pgs.

* cited by examiner

METHOD AND APPARATUS FOR ATTACHING HAIR EXTENSIONS TO HUMAN HAIR

CROSS-REFERENCE TO RELATED APPLICATIONS

This application is a continuation-in-part of U.S. patent application Ser. No. 14/333,256, filed Jul. 16, 2014, entitled "Method and an Apparatus for Attaching Hair Extensions to Human Hair," which claims priority to U.S. Provisional Application Ser. No. 61/847,330, filed Jul. 17, 2013, entitled "Hair Extension Integration System and Method," each of which is incorporated by reference herein in its entirety.

TECHNICAL FIELD

Embodiments of the disclosure relate generally to the field of personal grooming, for instance, to attaching hair extensions to human hair. Embodiments relate more particularly to the use of a crimping and fastening mechanism for ensuring a quick, safe and painless method of attaching hair extensions.

BACKGROUND

As beauty consciousness grows among people of all ages, an increasing number of men and women feel the need to look their best at all times. Hair styles serve as important part of a persona, because they are simultaneously public (visible to everyone), personal (biologically linked to the body) and highly malleable to suit cultural and personal preferences.

One way of enhancing the look of a particular hairstyle is by using hair extensions. Hair extensions, also known as "weft hair extensions", add length and/or fullness of volume to human hair. These extensions are a means to lengthen one's hair by incorporating artificial hair or natural hair, collected from other individuals, to one's own. There are many reasons men and women wear extensions. Sometimes, people desire longer hair or a greater volume of hair than they naturally have. Others gradually go bald, or have receding hair lines. A person of either gender might cut their hair and regret it later on. Some people have a hard time growing their hair once it reaches a certain length. Hair extensions help them reach their desired length. Some people who do not want to damage their own natural hair by dyeing it use hair extensions to add streaks of color throughout their hair.

Current methods for temporary hair augmentation include sew-ins, gluing, hair fusion, hair tape, metal coils, rubber bands and hair clips. Each of these methods has substantial drawbacks, however. Attaching hair extensions using the sew-in method is a painful and painstaking process that involves a needle and thread to join hair extensions to the client's natural hair. Often, the needle pricks the scalp during the process of hair extension. Gluing and hair fusion are also time-consuming processes that involve attaching small groups of hair to the client's own with a fixative. Due to the nature of the fixative, both of these types of hair augmentation processes often entail some loss of the client's natural hair during their removal. Hair tape is a fairly quick method of hair augmentation, but is not a reliable one as hair extensions attached to the client's natural hair in this manner may not attach securely if the client's hair is oily, and may cause hair loss when removing if the client's hair is dry. Metal coils and rubber bands are other time-consuming hair augmentation methods that involve the addition of small quantities of hair to even smaller clusters of the client's own hair. Both methods involve pulling of the client's natural hair at its roots, and often create hair loss with their removal. Hair clips are a quick method of hair extension that are simple enough for the client to attach herself. Hair clips can be worn during the day, but are removed prior to going to bed as they are uncomfortable to sleep in.

There is a need for a method for attaching hair extensions quickly and easily with a minimum of discomfort that also allows for their painless and easy removal and/or repositioning. There is a need for a suitable apparatus which, when used by a hair stylist on a hair extension client, facilitates the attachment of the hair extensions.

SUMMARY

In accordance with some embodiments, an apparatus is used for attaching a hair extension to a recipient's hair without injuring the recipient's scalp. The apparatus is a handheld tool having a first hand member and a second hand member. The first and second hand members are mechanically coupled to each other and the first hand member is user moveable in relation to the second hand member. The tool includes a fastening mechanism coupled to the first hand member. The fastening mechanism is configured to crimp a pliable material to form a fastener that attaches the hair extension to the recipient's hair. The tool also includes a shield mechanism, which is mechanically coupled to the first hand member. The shield mechanism includes safety feet having first and second positions. The shield mechanism is in the first position when the apparatus is in a mechanically biased quiescent position, and the shield mechanism is in a second position when the fastening mechanism is crimping the fastener. In the second position, the safety feet are interposed between the recipient's scalp and a cornrow of the recipient's hair. The safety feet move from the first position to the second position as the fastener is being crimped.

In accordance with some embodiments, a process attaches a hair extension to a recipient's hair. The method includes defining an anchoring structure for receiving attachment of the hair extension. The hair extension is positioned adjacent to the anchoring structure. A user employs a hair extension attachment apparatus to attach the hair extension to the anchoring structure, including manipulating a user manipulable hand member of the apparatus to position a shield mechanism between the recipient's scalp and a fastener as the fastener is being crimped. The apparatus crimps the fastener to attach the hair extension to the anchoring structure.

An apparatus is provided for attaching a hair extension to the recipient's hair. The apparatus includes a mechanism for crimping a fastener to attach the hair extension and includes a shield mechanism for preventing the fastener from contacting the recipient's scalp as the fastener is being crimped.

BRIEF DESCRIPTION OF THE DRAWINGS

In the accompanying figures, like reference numerals refer to corresponding parts throughout the figures These reference numerals are used in the detailed description to illustrate various embodiments and to explain various aspects and advantages of the present disclosure.

FIGS. 8A-1, 8A-2, 8A-3, 8B-1, 8B-2, 8B-3, 8C-1, 8C-2, 8C-3, 8D-1, 8D-2, and 8D-3 are views of a hair extension attachment device according to some embodiments, showing stages of its operation.

FIGS. 9A-1, 9A-2, 9A-3, 9B-1, 9B-2, 9B-3, 9C-1, 9C-2, 9C-3, 9D-1, 9D-2, and 9D-3 are views of a hair extension attachment device with a fixed shield according to some embodiments, showing stages of its operation.

FIGS. 10A-1, 10A-2, 10A-3, 10B-1, 10B-2, 10B-3, 10C-1, 10C-2, 10C-3, 10D-1, 10D-2, and 10D-3 are views of a hair extension attachment device with a retractable shield according to some embodiments.

DETAILED DESCRIPTION OF THE EMBODIMENTS

The above-mentioned needs are met by a method and apparatus using an apparatus, such as a hand-held apparatus, to attach one or more wefts of hair extensions to a recipient's hair. The fastener apparatus may, for instance, be similar to a surgical stapler, or other type of stapler, and may operate somewhat analogously to conventional surgical staplers. The following detailed description is intended to provide example implementations to one of ordinary skill in the art, and is not intended to limit the invention to the explicit disclosure, as one of ordinary skill in the art will understand that variations can be substituted that are within the scope of the invention as described.

Figure 1:
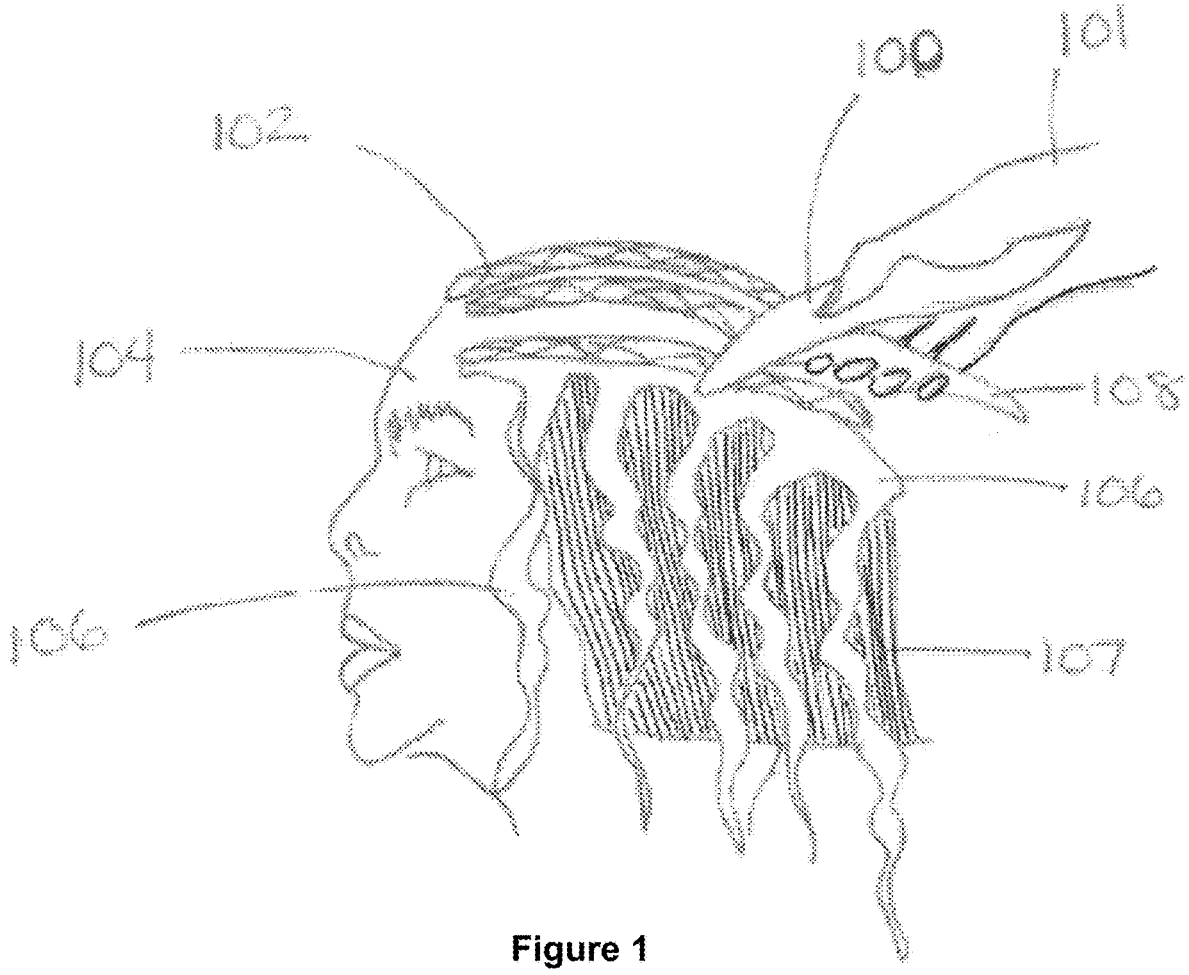
FIG. 1 is an exemplary view of a recipient receiving a hair extension according to some embodiments.

FIG. 1 is an exemplary view of a person 104, also referred to herein as a "recipient" or "client," having a hair extension 106 applied to the recipient's hair, according to some embodiments. As depicted in FIG. 1, a hand-held device 100 (described in detail below) is used by a hair stylist, hair salon employee, or other applying person 101, to attach hair extensions 106 to a recipient's hair. It is, of course, possible that the hair stylist 101 attaching the hair extension, and the person 104 receiving the hair extension, are the same person. That is, the recipient 104 may apply the hair extensions to herself.

The hair 107 of the recipient 104 is prepared for the attachment of the hair extension 106, for instance, by braiding into cornrows along the scalp of the person 104, to serve as a hair extension anchoring structure 102. In a preferred embodiment, a hair stylist 101 who wishes to integrate the weft hair extension 106 into a client 104's hair begins by producing an anchoring structure 102 from the client 104's hair. This is done by plaiting a tract of natural hair in one or more cornrows on the recipient's scalp. Cornrowing is a type of hair grooming where the hair is braided very close to the scalp, using an underhand, upward motion to produce a continuous, raised row.

The handheld device 100 is then employed to integrate one or more weft hair extensions 106 into each distinct tract of natural hair making up the anchoring structure 102. A hair mesh worn by the recipient 104 may alternatively be used as the anchoring structure when placed atop the recipient's natural hair. A wig or wig cap worn by the recipient 104, may alternatively be used as a hair extension to add length and volume to the recipient's own hair. In some embodiments, the hair extensions 106 and the anchoring structure 102 are coupled together in a substantially perpendicular manner, which might, for convenience, be thought of as being in a vertical and horizontal manner.

The hair extensions 106 are made up of a plurality of strands of hair or hair-like fibrous material that are arranged side by side (adjacent to each other) in order to form a linear arrangement, which may have the appearance of a row of hair. The weft hair extension 106 is a particular embodiment, which is shown and described as an example, but without limitation as to the possible configurations of hair extensions that might be employed. Typically, multiple extensions are attached to the recipient's own hair to give the natural appearance of longer or fuller hair, with the lowermost extension being attached near the nape of the neck.

The weft hair extensions 106 may vary with regards to their length, thickness and luster. Nevertheless, once attached, the hair extensions 106 remain securely attached to the anchoring structure 102. The hair extensions 106 so attached can be worn all day and all night and when engaging in strenuous activities such as running or swimming. When the need arises, however, hair extensions 106 attached using the fasteners described herein can be easily removed without damaging the naturally growing hair making up the anchoring structures.

In some embodiments, after the hair extensions 106 are secured to the anchoring structure 102, hair growth causes the distance between the hair extension 106 and the scalp to increase. As the hair grows, additional fastening agents can be employed to bring the hair extension closer to the scalp, maintaining the semblance of naturally growing hair.

As depicted in FIG. 1, the hair extension integration system comprises a hand-held device or tool 100 and a weft hair extension. In some embodiments, the hand-held tool 100 resembles a suture stapler. The terms "device," "apparatus," "hand-held device," and "tool" will be used interchangeably, but without limitation as to other embodiments. It should be understood that the device 100 does not cause the fastener to have direct contact with the scalp, as might be the case with a conventional device such as a surgical stapler. Rather, embodiments of the present device prevent such contact, for instance, by using a safety shield, or a spacer which maintains a predetermined distance between the fastener and the recipient's scalp. The predetermined distance may be a fixed distance, or may be adjustable.

The present apparatus further includes a user-manipulable hand member 108. As the hand member 108 is manipulated, for instance by squeezing, the movable safety shield is moved into place, and the fastener is crimped around the hair extension and the anchoring structure. More specifically, the squeezing causes the shield mechanism to move from the first position to the second position. For instance, the stylist 101 may manipulate the user-manipulable hand member 108 by squeezing it, to move it from the first position (such as a spring-loaded quiescent position) to the second position where the safety shields move towards each other to form a protective barrier between the recipient's scalp and the fastener as a fastener is crimped. The stylist then releases the user manipulable hand member 108, causing the shield mechanism to return to the initial position, for instance, by allowing the spring-loading to return the user-manipulable hand member 108 to its quiescent position.

Some embodiments use a collar mechanism, which the stylist moves from an initial position along the user manipulable hand member 108, causing it to vary its angle relative to the tool 100. This causes the safety shields to move into position. When the collar mechanism is slid back to its initial position, the safety shields move back, as well, for instance under the influence of the spring-loading. The collar may also be used as a lock, to hold the tool 100 in a closed position for storage.

Figure 2:
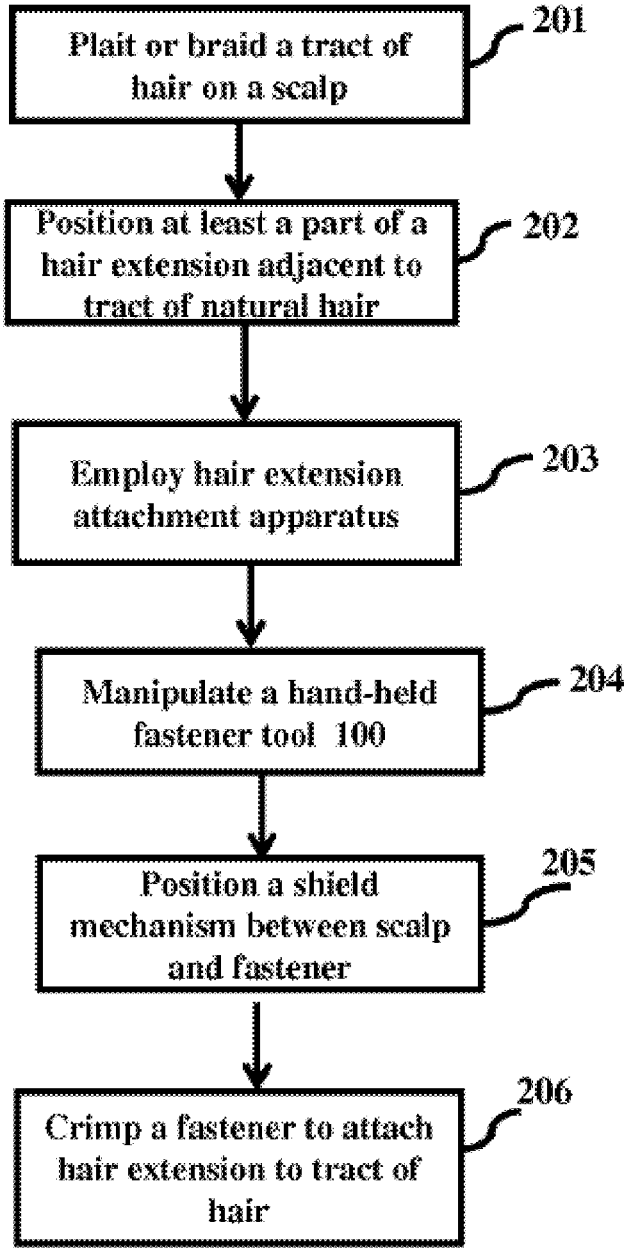
FIG. 2 is a flowchart depicting a process of attaching hair extensions using a hand-held device according to some embodiments.

FIG. 2 is a flowchart depicting a process of attaching hair extensions using a hand-held device, according to some embodiments. In some embodiments, a method for integrating hair extensions involves using the hand-held device 100 to attach the weft hair extension 106 directly on a tract of natural hair making up the anchoring structure 102. A fastener, such as a staple, is crimped around the hair extension 106 and the anchoring structure 102 to form a secure bond between them. The fastener used does not penetrate the scalp due to a barrier provided by a shield mechanism, herein also referred to as safety feet (as depicted in several of the drawings to be discussed below).

FIG. 2 is a flow diagram depicting a process to attach hair extensions to human hair, according to some embodiments.

At step 201, an anchoring structure is defined. "Anchoring structure" refers to something to which a hair extension will be attached. "Anchoring structure" may refer to a braid, cornrow, or other configuration of natural existing hair already present on the recipient's scalp or skin. Alternatively, an anchoring structure may be a wig cap, mesh, or other suitable appliance worn on the recipient's head. The appliance can be used in conjunction with the braid or cornrow. For instance, a fastener can be crimped so as to hold both the braid or cornrow, and also an appliance placed on the recipient's head over the braid or cornrow. Such an appliance should be reasonably secure on the recipient's head, so as to provide a secure anchoring support for the hair extension to be attached.

The term "defined" or "defining" is broadly intended either to mean creating an anchoring structure, such as by braiding the hair naturally present or adding an appliance such as the aforementioned wig cap or mesh, or identifying an anchoring structure, such as a hair braid that is already present.

In the embodiment of FIG. 2, for instance, a tract of hair is plaited or braided on the scalp. Doing so produces the anchoring structure 102, to which the hair extension 106 will be attached. In some embodiments of such an anchoring structure 102, the tract of hair can be braided into a cornrow as shown in FIG. 1. Accordingly, as the braid proceeds along the scalp region from one end to the other, the successive hairs are woven into the braid near their roots, anchoring the cornrow right along the scalp. The anchoring structure 102 provides sufficient support for the hair extension 106 to be attached, so that the weight of the hair extension 106, and the tension on the hair extension 106 caused by activities such as brushing or combing the hair extension 106, does not easily detach the hair extension 106, and does not pull out natural hair by the roots.

In some embodiments, the size of the cornrow and the depth of the safety shield of the hand-held device are chosen for suitable compatibility with each other. For instance, a standard size cornrow is approximately 35 mm wide.

At step 202, at least a part of the hair extension 106 is positioned adjacent to a tract of natural hair making up the anchoring structure 102. In some embodiments, the hair extension 106 is positioned adjacent to the anchoring structure 102 such as the cornrow. Attached in this manner, the hair extension gives the semblance of emerging from the scalp itself, thus creating the appearance of naturally growing hair.

At step 203, the hair stylist 101 positions the hair extension attachment device 100 along the anchoring structure 102 at the point where the hair extension 106 is to be attached. The orientation of the anchoring structure 102, the hair extension 106, and the device 100, relative to each other, may be chosen according to the judgment and experience of the hair stylist 101.

In some embodiments, the handle members 360 and 108 of the device 100 may be biased, such as by spring-loading, into a quiescent position which is overcome as the stylist 101 squeezes the handle members (step 204). As the handle members are manipulated, two mechanical activities take place, in a predetermined sequence related to the degree to which the handles are squeezed.

First, the safety shields 302 are moved from the quiescent position into a position that shields the recipient's scalp from the fastener (step 205).

Second, a fastener is then crimped to be attached to the hair extension 106 and cornrow 102 (step 206).

After the hair extension attachment apparatus 100 of the present subject matter is employed, the stylist 101 releases the handle 108 of the device 100, and the handle 108 returns to its quiescent state, for instance, by the agency of the spring-loaded biasing. Then, the safety shields 302 return to their open position, and the stylist 101 may freely move the hand-held device 100 to another position to complete additional points of attachment for hair extension 106.

The various actions in the method of FIG. 2 may be performed in the order presented, in a different order, or simultaneously. Further, in some embodiments, some actions listed in FIG. 2 may be omitted.

Figure 3:
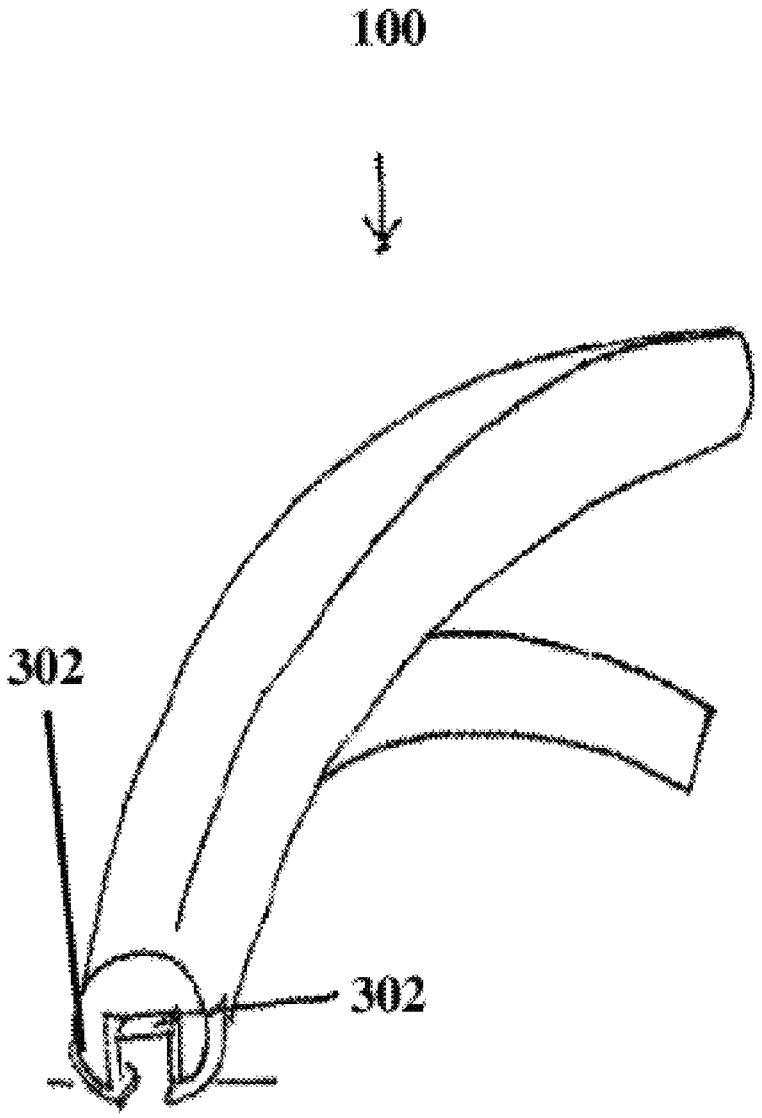
FIG. 3 is a detailed section view of a hand-held device for attaching hair extensions according to some embodiments.

FIG. 3 is a section view depicting a hand-held tool 100, which is also referred to herein as a "hand-held device" or a "fastening device," including a shield mechanism of the fastening device, according to some embodiments. The first (open) position of the device is configured to at least partially enclose the terminal ends of the fastener.

The fastening device 100 further comprises a nozzle configured to discharge the fastener, typically one fastener at a time. The fastener comprises a U-shaped member having a pair of terminal ends which may be crimped together in conventional fashion, toward the middle portion of the fastener, thereby securing hair extension 106 and anchoring structure 102 together.

The pair of safety feet 302 is actuated to a second (closed) position before the fastener is discharged. In this embodiment, the discharged fastener presses down on the pair of safety feet 302. The pair of terminal ends, which comprise a malleable material, bend inwardly in conformance to the contour of the safety feet 302. The inward bend created by the junction in the pair of safety feet 302 forms a crimp on the fastener that at least partially encloses the tract of natural hair making up the anchoring structure 102 and the weft hair extension 106.

In some embodiments, the safety feet 302 move inward, toward each other, in concert with user manipulation of the handle of the tool 100. In some embodiments, the handle is spring-loaded to a mechanically biased quiescent, open position in which the safety feet 302 are retracted. The spring loading can be provided by a suitable spring member, such as a torsion spring or a flex arm (not shown). The stylist squeezes the handle, effectively converting handle manipulation into corresponding rotational movement of the safety feet 302. Finally, the pair of safety feet 302 is actuated to an open position to release the device 100 for the next hair integration. The pair of safety feet 302 disengages from around the hair tract of natural hair making up the anchoring structure 102 and weft hair extension 106, leaving the fastener securely attached to both sets of hair. Thus, after the stylist attaches a hair extension to the recipient's hair, releasing the handle causes the spring-loading to return the handle to the quiescent position, and correspondingly to cause the cam or other structure to rotate the safety feet back to their retracted, quiescent positions.

Different embodiments of the present subject matter may implement crimping of the fastener, and movement of the safety feet 302, as a function of rotational movement of the handle 108 of the tool 100. In one embodiment, as the handle 108 is gradually squeezed inward relative to the tool 100, the safety feet 302 first move into position, and then the fastener is crimped. Thus, the safety feet 302 are already in position, as the fastener is crimped, so that the recipient's scalp is protected from the fastener. In another embodiment, the movement of the safety feet 302 and the crimping of the fastener can take place simultaneously. Both actions happen as the handle 108 passes through the same angular rotation caused by the squeezing. In some embodiments, the safety feet 302 are sufficiently in position that the recipient's scalp is protected from injury from the fastener, even as the fastener is being crimped. In addition to these embodiments, other embodiments, within the spirit and scope of the present subject matter, implement the squeezing of the handle 108, and the movement of the safety feet 302 and the crimping of the fastener, in any sequence, or simultaneity, which may be suitable to meet the needs of stylists and hair extension recipients.

Figure 4:
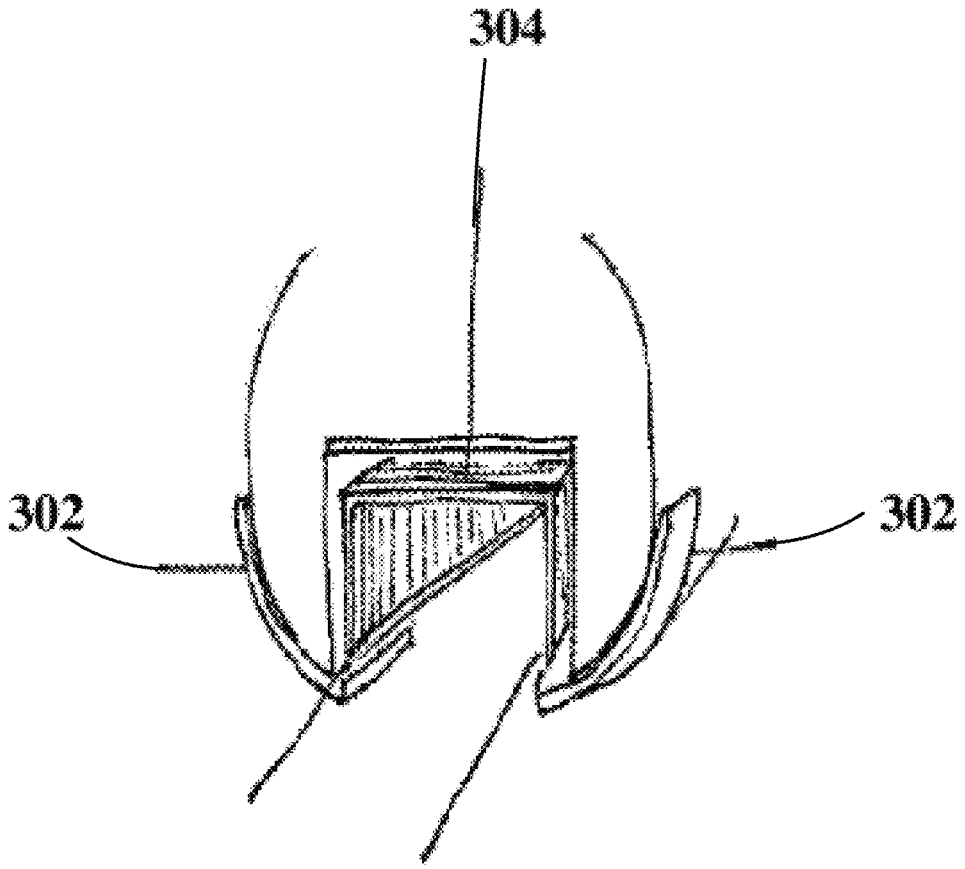
FIG. 4 is a close-up section view of the hand-held device of FIG. 3, showing the shield mechanism of the hand-held apparatus, according to some embodiments.

FIG. 4 is a close-up section view of the front portion of the hand-held tool of FIG. 3, showing further details of the implementation of the present embodiment. The tool 100 comprises safety shields 302, herein also referred to as safety feet, that slide from an open position (as shown in FIG. 4) to a closed position. The open position of FIG. 4 is configured to gather and release the tract of natural hair making up the anchoring structure 102.

Figure 5:
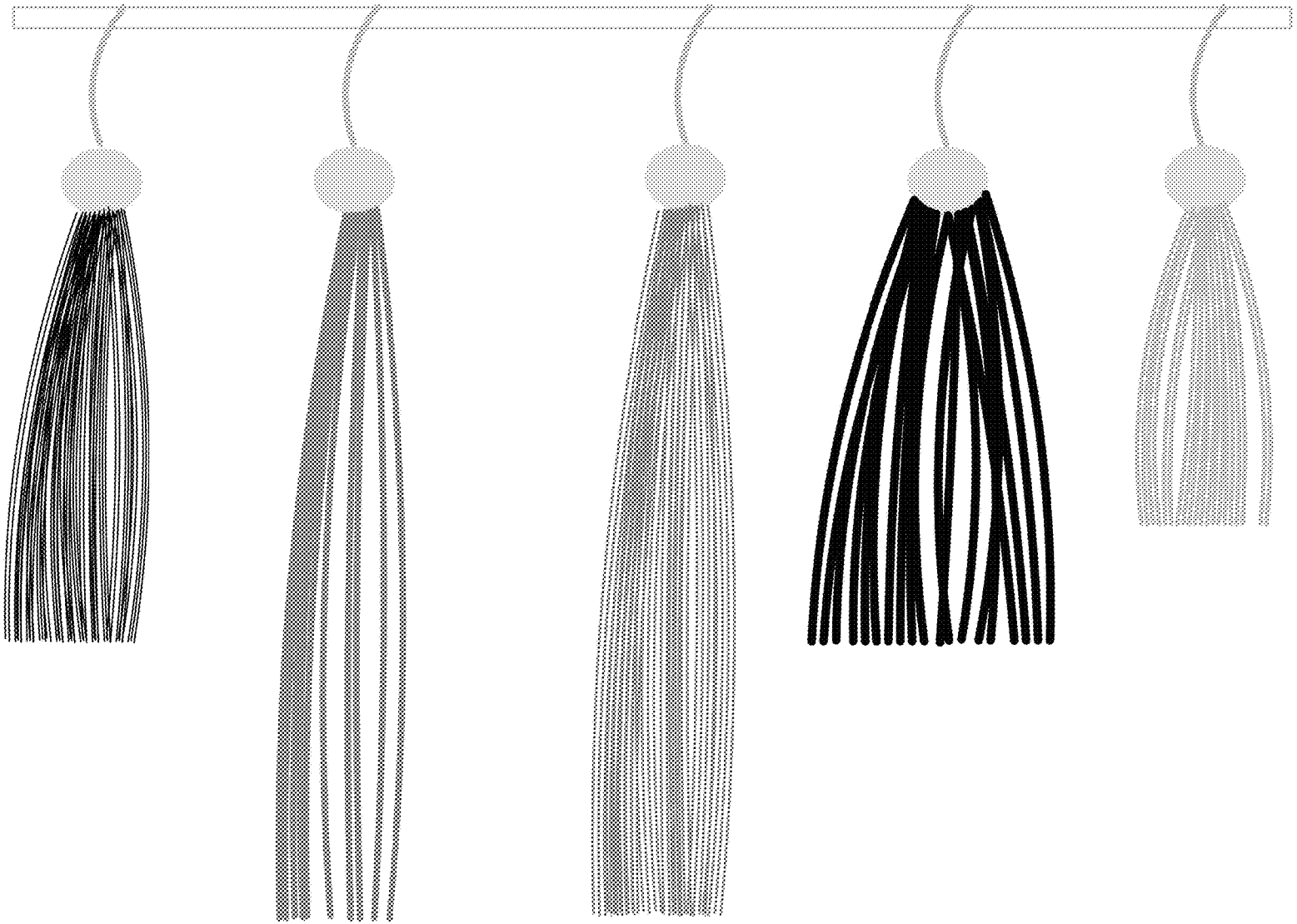
FIG. 5 illustrates various different types of hair extensions, according to some embodiments.

FIG. 5 illustrates a rack of hangers bearing hair extensions. Hair extensions have different colors, styles, and lengths, according to the embodiments as disclosed herein. As shown, natural hair extensions, obtained from donors, and artificial-fiber hair extensions can vary in texture, color, and sheen. Hair extensions can be aggregations of individual hairs assembled into a weft, or can be pre-braided.

FIGS. 6A, 6B, 6C, and 6D show a sequence of close-up views of the head of the hand-held tool 100 of FIGS. 3 and 4, showing stages during the operation of the tool 100 to attach a hair extension to the anchoring structure on the scalp of the hair extension recipient.

Figure 6A:
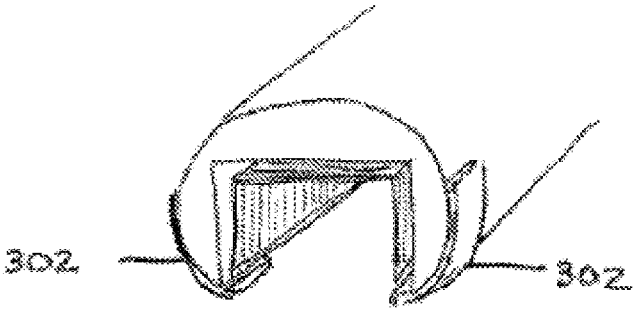
FIGS. 6A, 6B, 6C, and 6D are close-up, section views of stages of operation of a hand-held apparatus, during the process of using the hand-held device to attach a hair extension.

FIG. 6A shows an initial position of the head of the tool 100, before the stylist begins to manipulate the handle to attach the hair extension. As shown, the safety shields 302 are in an initial, retracted position, in which there is open space for positioning the head of the tool 100 over the anchoring structure, with a hair extension positioned adjacent to the anchoring structure, in preparation for attaching. The initial, retracted position of the safety shields 302 may be a quiescent position, in which the spring-loaded handle biases the handle to its initial position, and the tool 100 has not yet been manipulated by the stylist. For convenience, it may be said, without limitation, that the initial, quiescent position of the safety shields 302 is an open position, and that user manipulation urges the safety shields 302 toward a closed position.

Figure 6B:
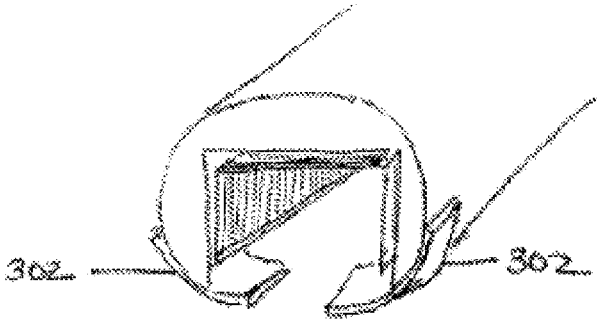

FIG. 6B shows a position in which the user has begun to manipulate the handle of the tool 100 to attach the hair extension to the anchoring structure. According to the convention mentioned just above, it may be said that the safety shields 302 are being manipulated from the initial open position, toward a closed position, and are now in a semi-closed position. As shown, the fastener has not yet been crimped to do the actual attaching, but the safety shields 302 have rotated from the quiescent positions closer together. As such, they enclose the anchoring structure and the hair extension 106. In some embodiments, as the stylist partially manipulates the handle, a structure such as a cam rotates the safety shields into this position before the fastener begins to crimp.

Figure 6C:
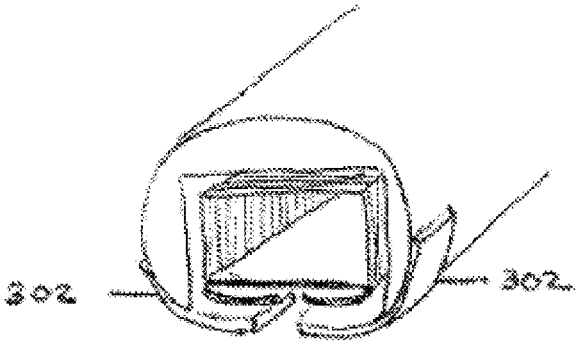

FIG. 6C shows a position in which the user has continued to manipulate the handle of the tool 100, beyond that of FIG. 6B. In this position, the safety shields 302 have moved even closer together and one fastener is dislodged from the rest. This may be done in conventional fashion, by having a forcing member (not shown) pushing against the middle portion of the fastener to detach it from the strip of fasteners contained in the tool 100. In some embodiments, the fastener is crimped, in conventional fashion, by forcing the ends against an anvil which has a groove to direct the ends of the fastener to an inwardly crimped configuration. Accordingly, the crimped ends of the fastener take hold of the anchoring portion of the person's hair, as well as the hair extension. As a result, the hair extension is securely bound to the anchoring portion, and will remain attached until the fastener is extracted in order to release the hair extension. Note, also, that because the shields 302 have been moved to a closed or semi-closed position, they protect the recipient's scalp from injury from the ends of the fastener.

Figure 6D:
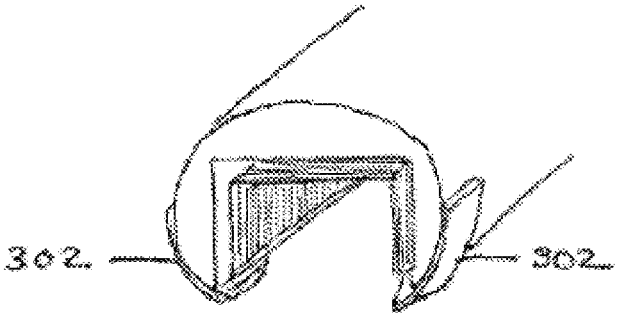

FIG. 6D shows a position, following that of FIG. 6C, in which the stylist has released the handle of the tool 100 and allowed the spring-loaded tool to return to its quiescent position. As shown, the safety shields 302 have moved back to their quiescent position, far enough apart to allow the stylist to move the tool 100 to another part of the recipient's cornrowed hair in preparation for attaching another section of the weft hair extension thereto, if so desired.

Figure 7A:
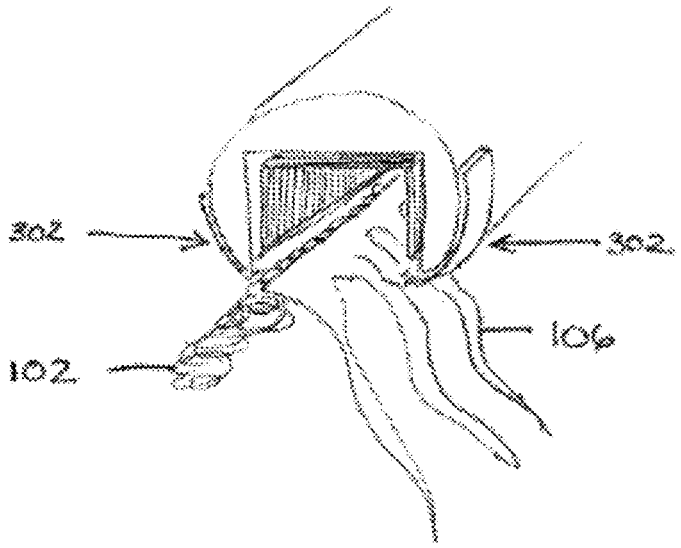
FIGS. 7A, 7B, and 7C depict operation of a hair extension attachment method, similar to those of FIGS. 6A through 6C, but further showing the person's hair and the hair attachment in their respective positions.
Figure 7B:
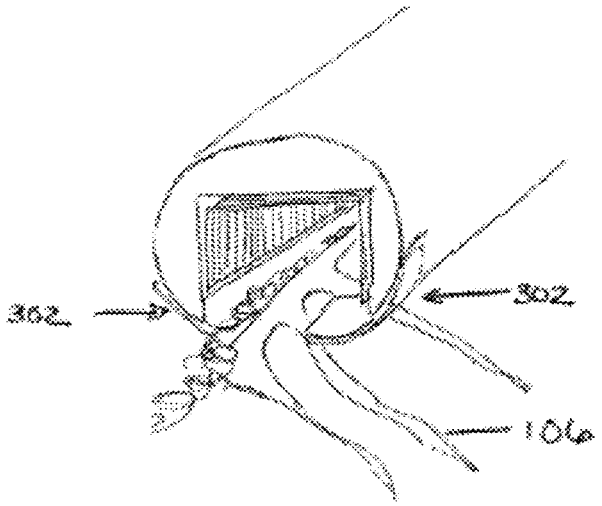
Figure 7C:
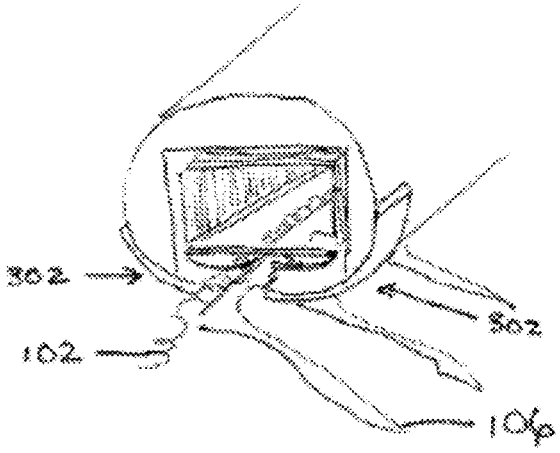

FIGS. 7A, 7B and 7C show the operation of a tool 100, such as that of FIGS. 3, 4, and 6A through 6D, showing the person's hair anchoring structure 102 and the hair extension 106 as the tool 100 is used to attach the hair extension. The three illustrated successive stages generally correspond with those of FIGS. 6A, 6B, and 6C respectively.

FIG. 7A depicts an initial stage of the exemplary hair extension in preparation to being attached to the recipient's hair, according to some embodiments. Before the stylist manipulates the tool 100, the safety shields 302 are in their quiescent, open position. The hair extension 106 has been positioned adjacent to the anchoring structure 102, and the tool 100 is held such that its head, with the fastener dispensing and crimping apparatus, is positioned over the hair extension 106 and the anchoring structure 102.

FIG. 7B depicts a view subsequent to that of FIG. 7A, in which the stylist has begun to manipulate the tool 100, for instance, by squeezing the handle so as to activate the cam to rotate the safety shields 302 beneath the hair extension 106 and the desired area of the anchoring structure 102, where the fastener will be crimped in place.

FIG. 7C depicts a view subsequent to that of FIG. 7B, in which the attachment of the hair extension 106, according to the embodiments as disclosed herein. As shown, the safety shields 302 have moved further into position, and the fastener has been crimped so as to attach the hair extension 106 to the anchoring structure 102. After this, the stylist releases the handle of the tool 100, and the safety shields 302 return to their spring-loaded quiescent position, comparable to that of FIG. 7A. In some embodiments, if the weft hair extension 106 is exceptionally heavy, the process may be repeated in the same area, utilizing additional fasteners for increased security.

In the discussion which follows, several embodiments of the hand-held device 100, described above, will be described in further detail. In the drawings, the embodiments are shown in side and front views, along with detailed illustrations of the fastener and shield mechanisms.

Figures 1, 8A:
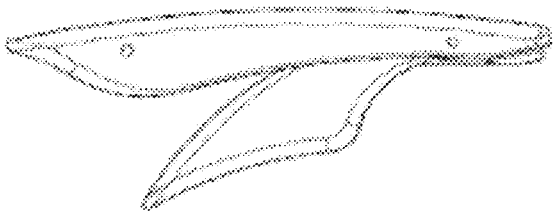
Figures 2, 8A:
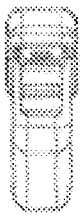
Figures 3, 8A:
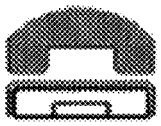
Figures 1, 8B:
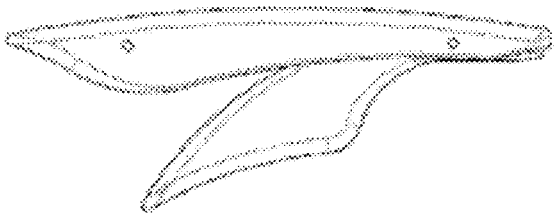
Figures 2, 8B:
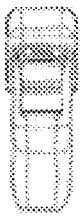
Figures 3, 8B:
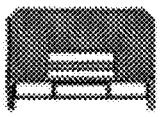
Figures 1, 8C:
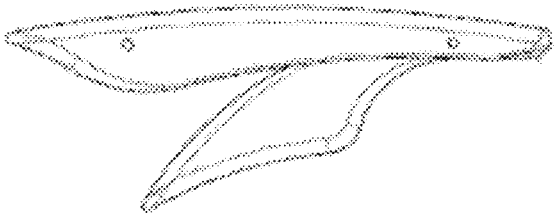
Figures 2, 8C:
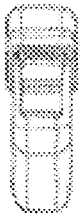
Figures 3, 8C:
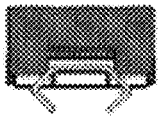
Figures 1, 8D:
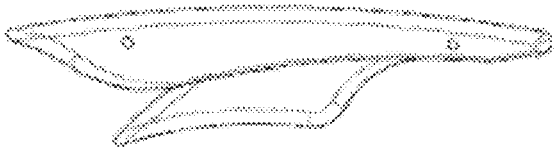
Figures 2, 8D:
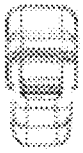
Figures 3, 8D:
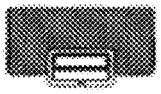
Figures 1, 9A:
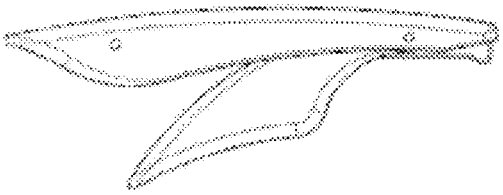
Figures 2, 9A:
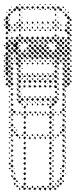
Figures 3, 9A:
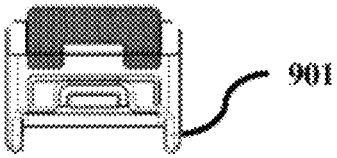
Figures 1, 9B:
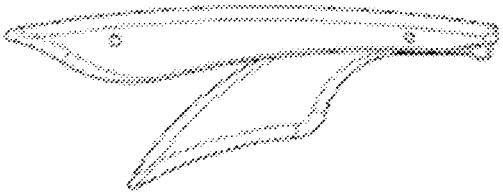
Figures 2, 9B:
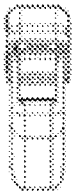
Figures 3, 9B:
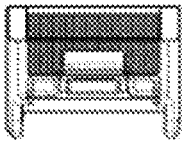
Figures 1, 9C:
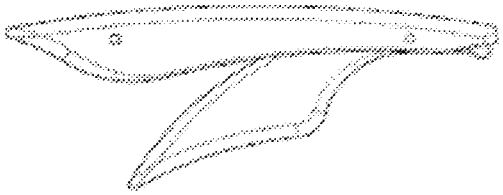
Figures 2, 9C:
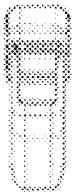
Figures 3, 9C:
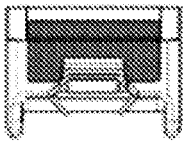
Figures 1, 9D:
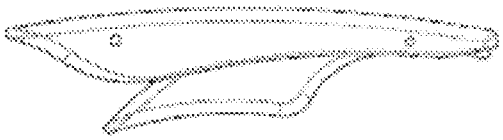
Figures 2, 9D:
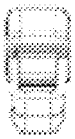
Figures 3, 9D:
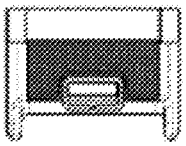
Figures 1, 10A:
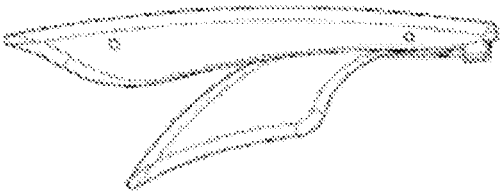
Figures 2, 10A:
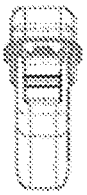
Figures 3, 10A:
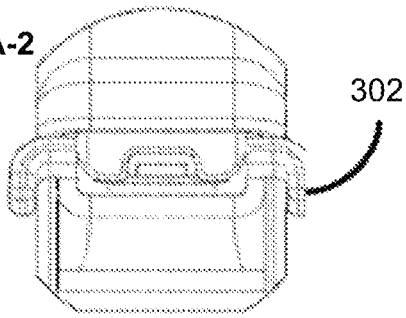
Figures 1, 10B:
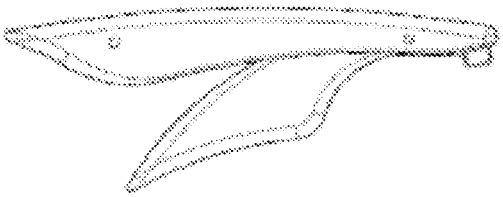
Figures 2, 10B:
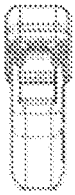
Figures 3, 10B:
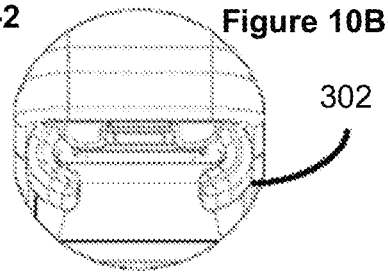
Figures 1, 10C:
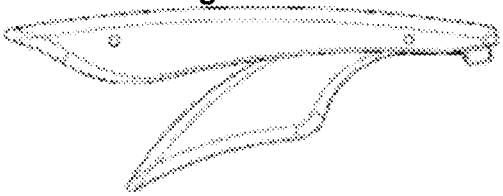
Figures 2, 10C:
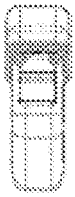
Figures 3, 10C:
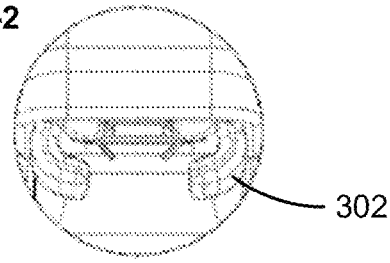
Figures 1, 10D:
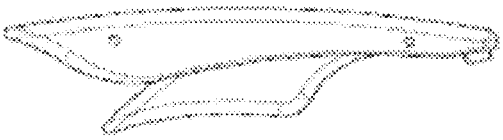
Figures 2, 10D:
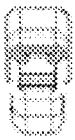
Figures 3, 10D:
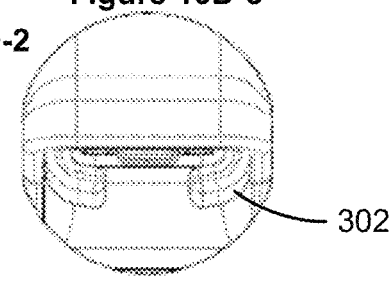

FIGS. 8A-1, 8A-2, 8A-3, 8B-1, 8B-2, 8B-3, 8C-1, 8C-2, 8C-3, 8D-1, 8D-2, and 8D-3 show views of a hand-held device such as the device 100 described above. There are three views for each stage of operation, including a side view (left, FIGS. 8A-1, 8B-1, 8C-1, and 8D-1), a front view (center, FIGS. 8A-2, 8B-2, 8C-2, and 8D-2), and a detailed portion of the front view, showing the fastener as it is being crimped (right, FIGS. 8A-3, 8B-3, 8C-3, and 8D-3). As shown in the side views FIGS. 8A-1, 8B-1, 8C-1, and 8D-1, the handheld device has two members, which may be squeezed together as the stylist grips it. For illustrative purposes with reference to these drawings, the two members may conveniently be considered, without limitation, as upper and lower members 360 and 108. In particular, FIGS. 8D-1, 8D-2, and 8D-3 show the fully-squeezed configuration, in which the lower member 108 is positioned closest to the upper member 360 due to the stylist's squeezing. Likewise, the front view in FIG. 8D-2 shows the lower member 108 retracted within the upper member 360. In the detailed views FIGS. 8A-3, 8B-3, 8C-3, and 8D-3, an alternative method for crimping the fastener is shown. FIGS. 8A-1, 8A-2, and 8A-3 illustrate a first stage of operation, which is the starting condition. FIGS. 8B-1, 8B-2, and 8B-3 illustrate a second stage of operation, in which the handle is partially squeezed. FIGS. 8C-1, 8C-2, and 8C-3 illustrate a third stage of operation, in which the handle is further partially squeezed. FIGS. 8D-1, 8D-2, and 8D-3 illustrate a fourth stage of operation, in which the handle is fully squeezed.

In this embodiment, the anvil that crimps the fastener is a moveable element contained in the hand-held device 100. The anvil shapes the fastener by pressing down on the fastener from above as it dislodges a single fastener from a row of fasteners. The fastener's crimped shape is determined by this action, and results in the crimped fastener having four points of inflection.

FIGS. 9A-1, 9A-2, 9A-3, 9B-1, 9B-2, 9B-3, 9C-1, 9C-2, 9C-3, 9D-1, 9D-2, and 9D-3 show views, similar to those of FIGS. 8A-1 through 8D-3, of an embodiment in which the recipient's scalp is protected from injury from the fasteners by means of fixed-position members, such as spacers 901, that maintain a predetermined distance between the fastener and the recipient's scalp. As shown, particularly in FIGS. 9C-1 through 9D-3, the fasteners are held at a specific height by the spacers 901, so that they are crimped without touching the recipient's scalp. FIGS. 9A-1, 9A-2, and 9A-3 illustrate a first stage of operation, which is the starting condition. FIGS. 9B-1, 9B-2, and 9B-3 illustrate a second stage of operation, in which the handle is partially squeezed. FIGS. 9C-1, 9C-2, and 9C-3 illustrate a third stage of operation, in which the handle is further partially squeezed. FIGS. 9D-1, 9D-2, and 9D-3 illustrate a fourth stage of operation, in which the handle is fully squeezed.

FIGS. 10A-1, 10A-2, 10A-3, 10B-1, 10B-2, 10B-3, 10C-1, 10C-2, 10C-3, 10D-1, 10D-2, and 10D-3 show views, again similar to those of FIGS. 8A-1 through 8D-3 and 9A-1 through 9D-3, of an embodiment in which the recipient's scalp is protected from injury from the fasteners by means of movable members, such as safety shields 302, which intervene between the fastener and the recipient's scalp as the fastener is crimped. As shown, particularly in FIGS. 10C-1 through 10D-3, as the fastener is being crimped, the safety shields 302 move into position between the fastener and the recipient's skin. Movement of the safety shields, as well as the crimping of the fastener, is driven by the squeezing of the upper and lower members of the device 100 by the stylist. Thus, the safety shields can be moved into position to protect the recipient's scalp before the fastener is crimped. FIGS. 10A-1, 10A-2, and 10A-3 illustrate a first stage of operation, which is the starting condition. FIGS. 10B-1, 10B-2, and 10B-3 illustrate a second stage of operation, in which the handle is partially squeezed. FIGS. 10C-1, 10C-2, and 10C-3 illustrate a third stage of operation, in which the handle is further partially squeezed. FIGS. 10D-1, 10D-2, and 10D-3 illustrate a fourth stage of operation, in which the handle is fully squeezed.

Figure 11:
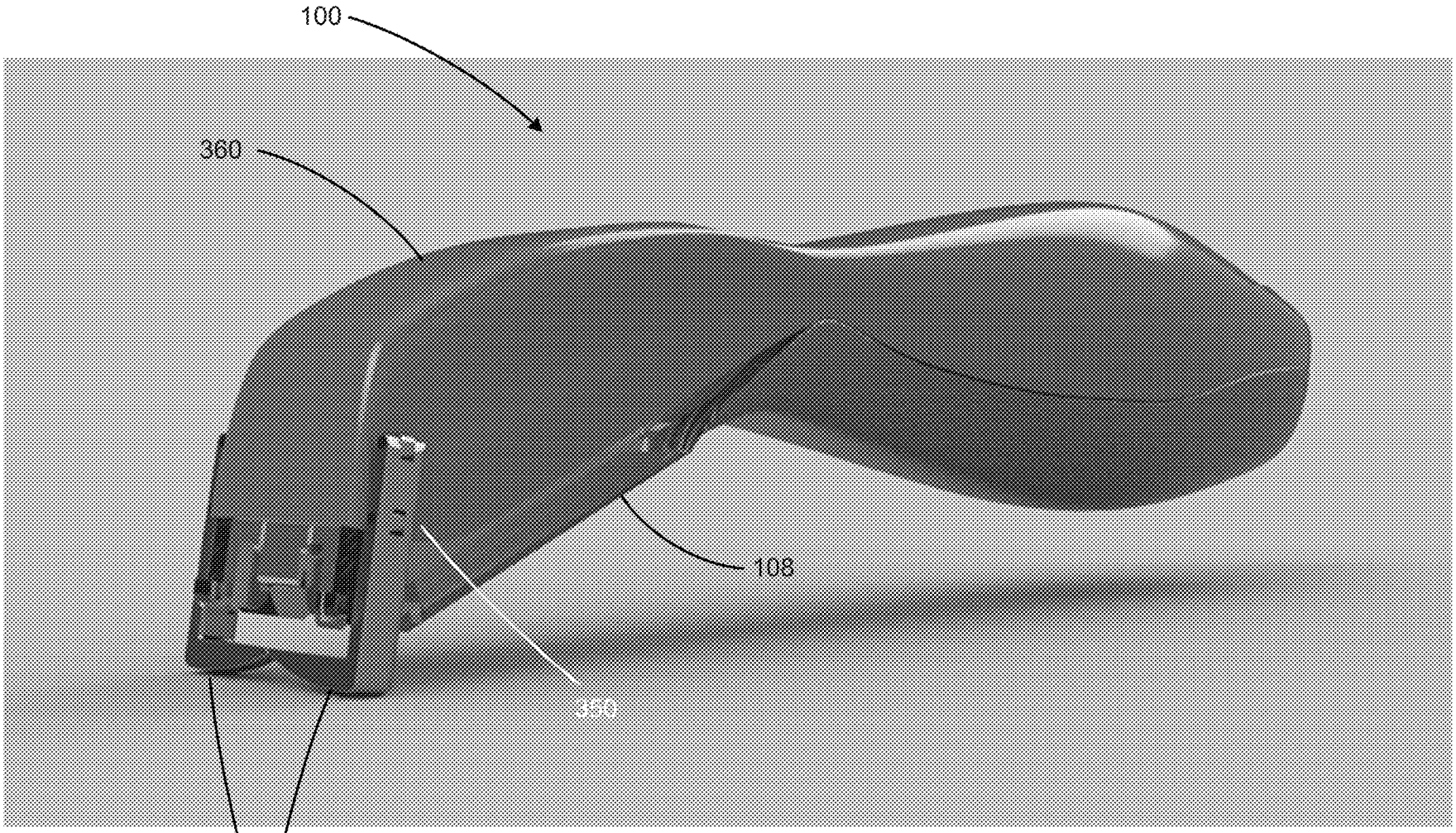
FIG. 11 is an illustration of a hand-held apparatus for attaching hair extensions in accordance with some embodiments.

FIG. 11 illustrates a hand-held apparatus 100 according to some embodiments. In this illustration, the safety shields 302 are positioned as they would be interposed between a recipient's scalp and a cornrow of the recipient's hair (i.e., while crimping a fastener). In some embodiments, as illustrated in FIGS. 12A-12G, the safety shields 302 rotate about a hinge-point 350 as the apparatus 100 crimps a fastener to attach a hair extension to the recipient's hair. Both the crimping and the movement of the safety shields 302 are mechanically performed by squeezing the lower member 108 toward the upper member 360.

Figure 12A:
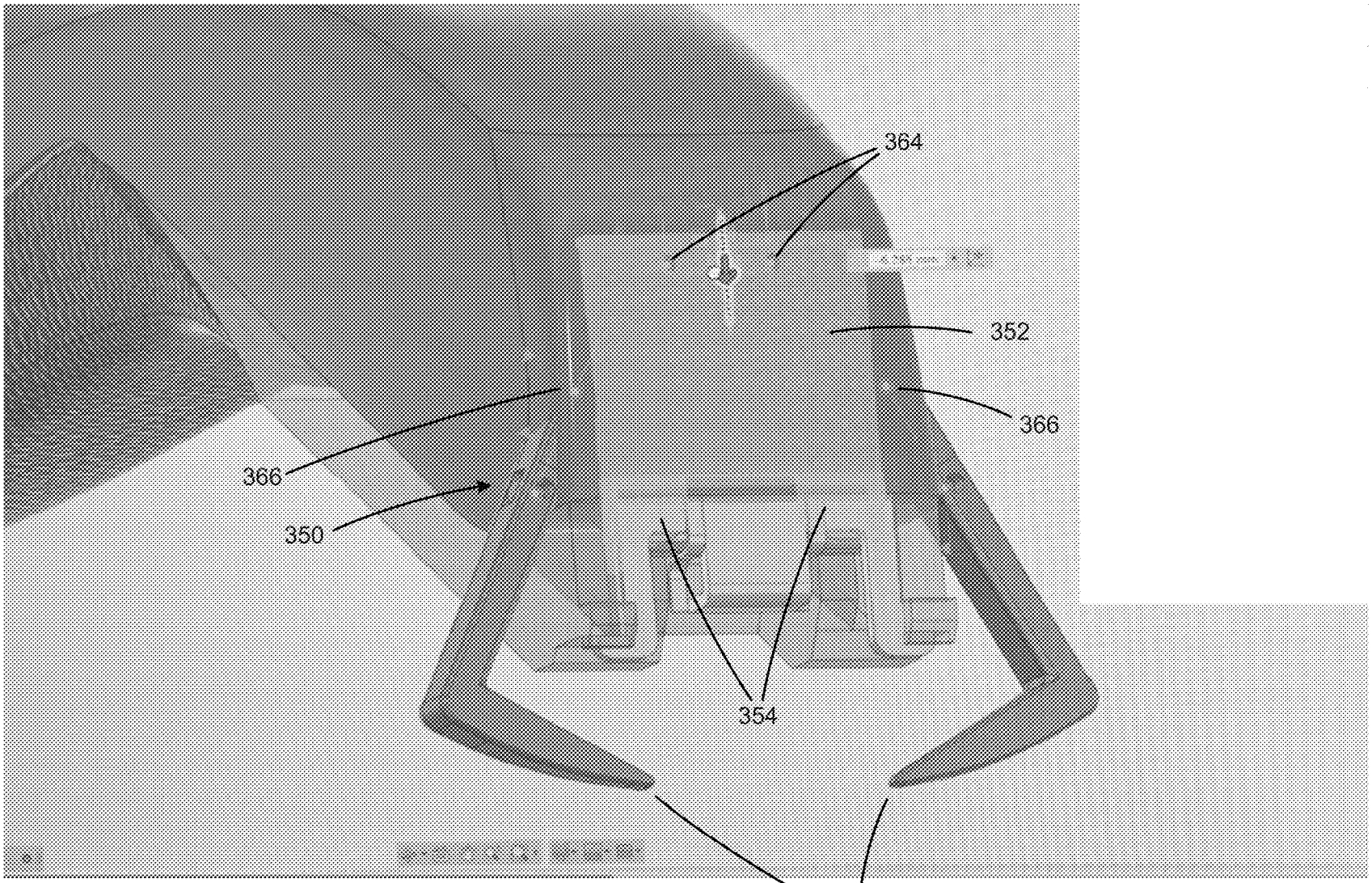
FIGS. 12A-12G illustrate operation of a hand-held apparatus, including movement of safety shields, in accordance with some embodiments.
Figure 12B:
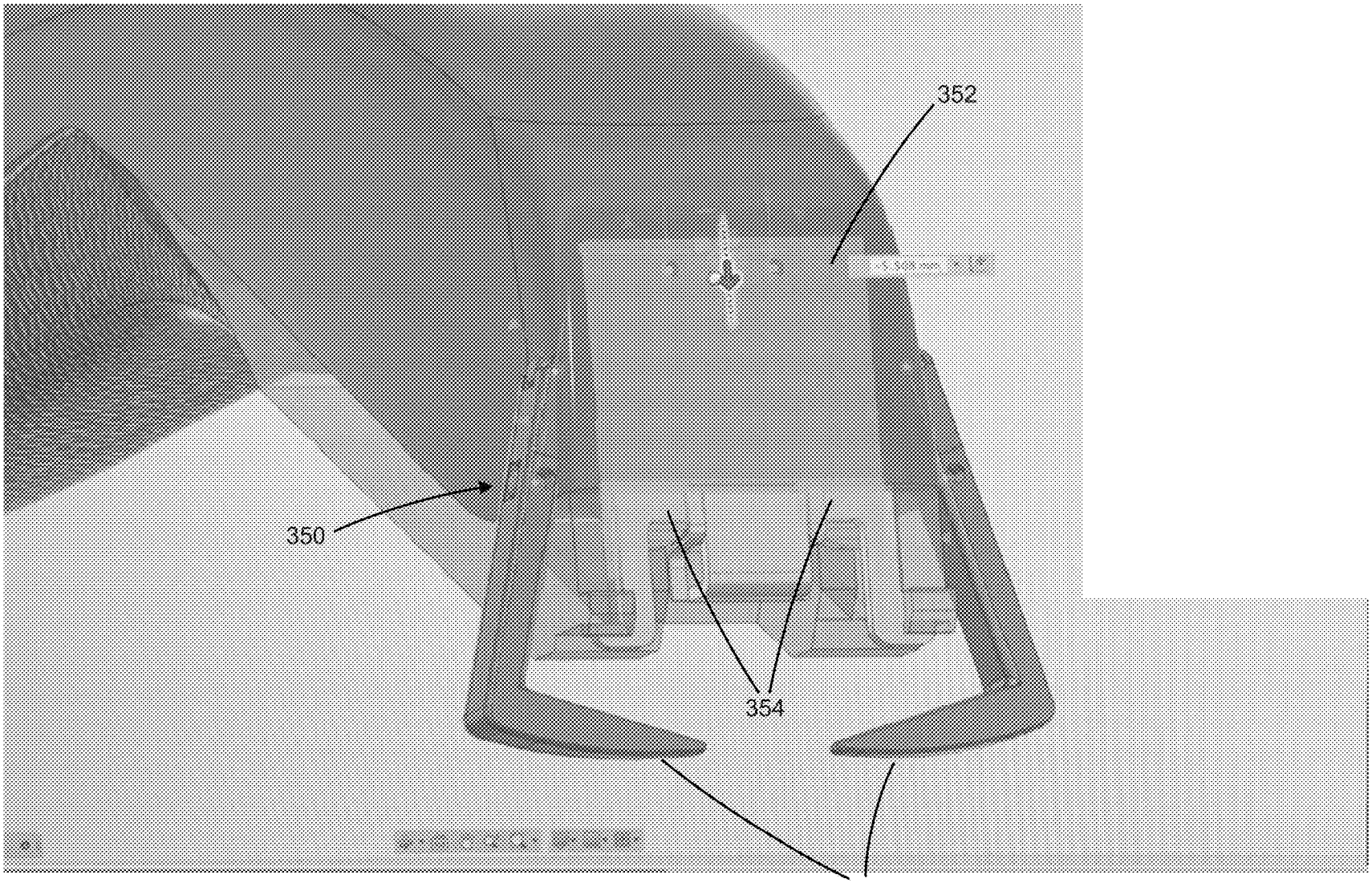
Figure 12C:
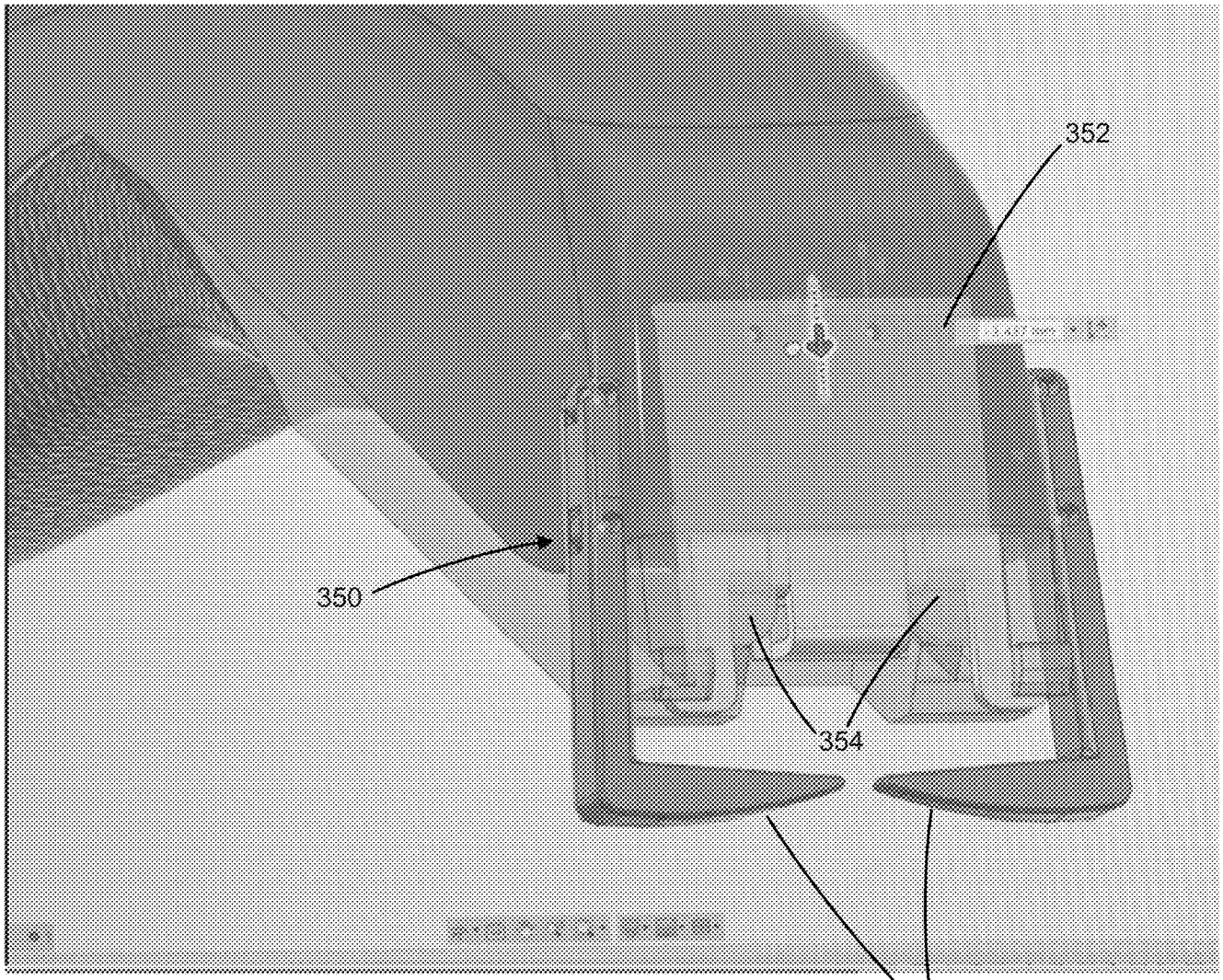
Figure 12D:
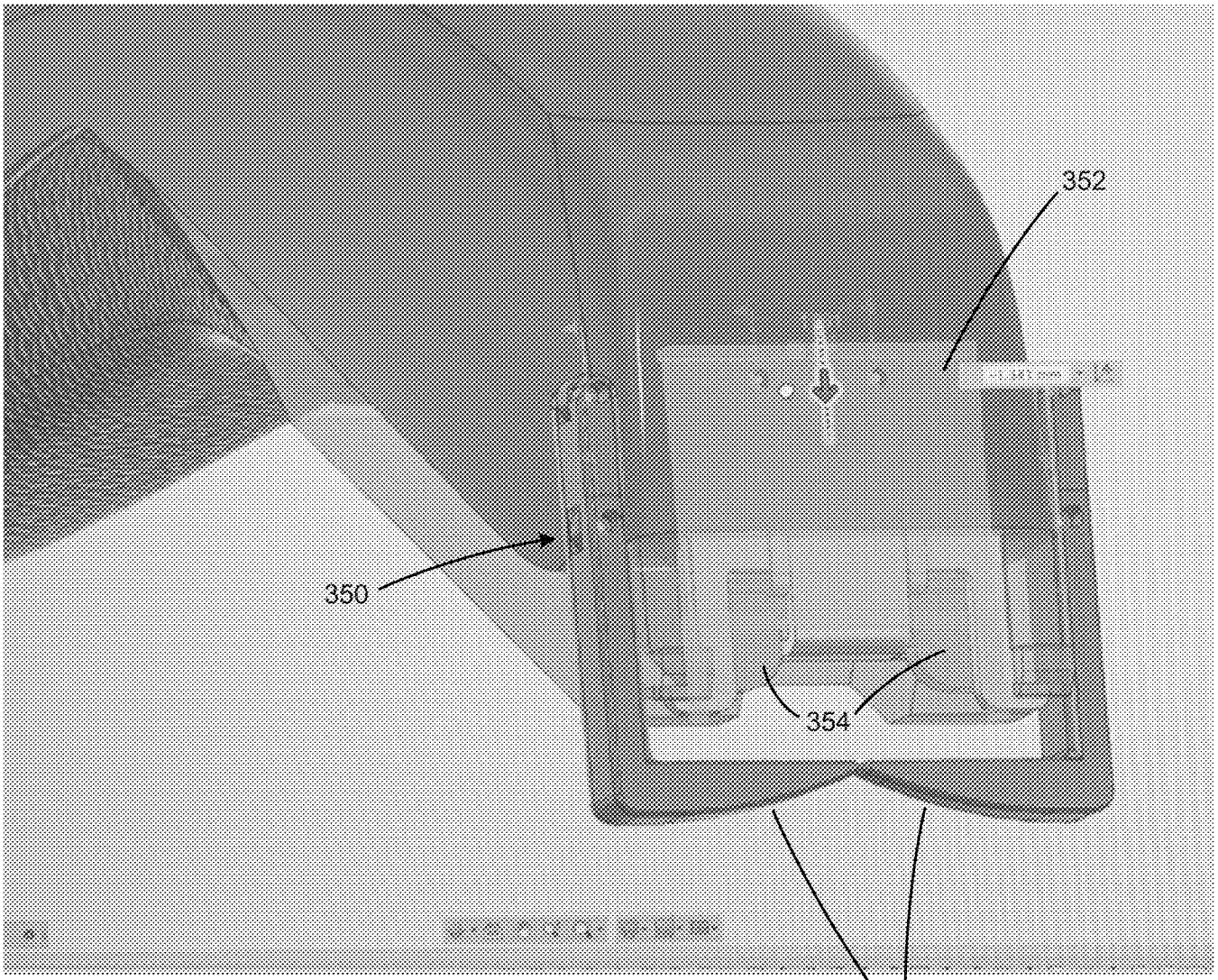
Figure 12E:
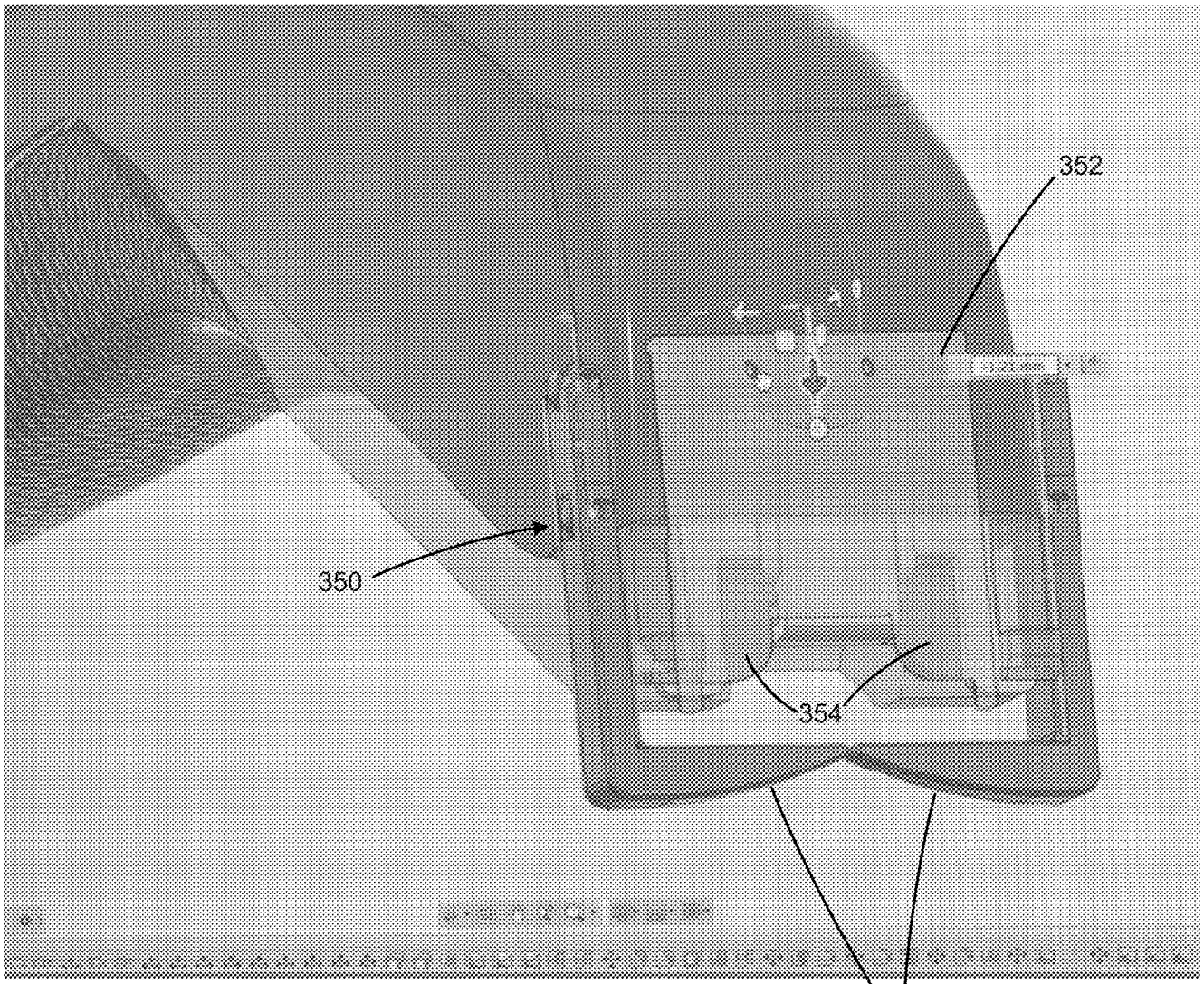

FIGS. 12A-12G are a temporal sequence of images from a video that illustrates usage of a hand-held apparatus according to some embodiments. In FIG. 12A, the safety shields are in the open position (e.g., the mechanically biased quiescent position). In some embodiments, the apparatus 100 includes an internal driver plate 352, which controls the movement of the crimping nubs 354 and the safety shields 302 (also referred to as safety feet). The driver plate 352 is not generally visible during operation of the apparatus 100; it is shaded here to illustrate the operation.

In some embodiments, the crimping nubs 354 are attached to (or are integrally part of) the lower portion of the driver plate 352. The crimping nubs 354, during operation, bend the outer ends of a fastener in order to attach a hair extension to the recipient's hair. The driver plate 352 is also coupled to the safety shields. In the illustrated embodiment, the safety shields 302 are connected to the driver plate 352 at the points 364. In some embodiments, the connections at the points 364 are rotatable so that vertical motion of the driver plate 352 converts to rotation of the safety feet 302 about the pivot points 350. In some embodiments, there are intermediate pivot points 366 to convert the vertical motion of the driver plate into the proper motion of the safety feet 302.

Figure 12F:
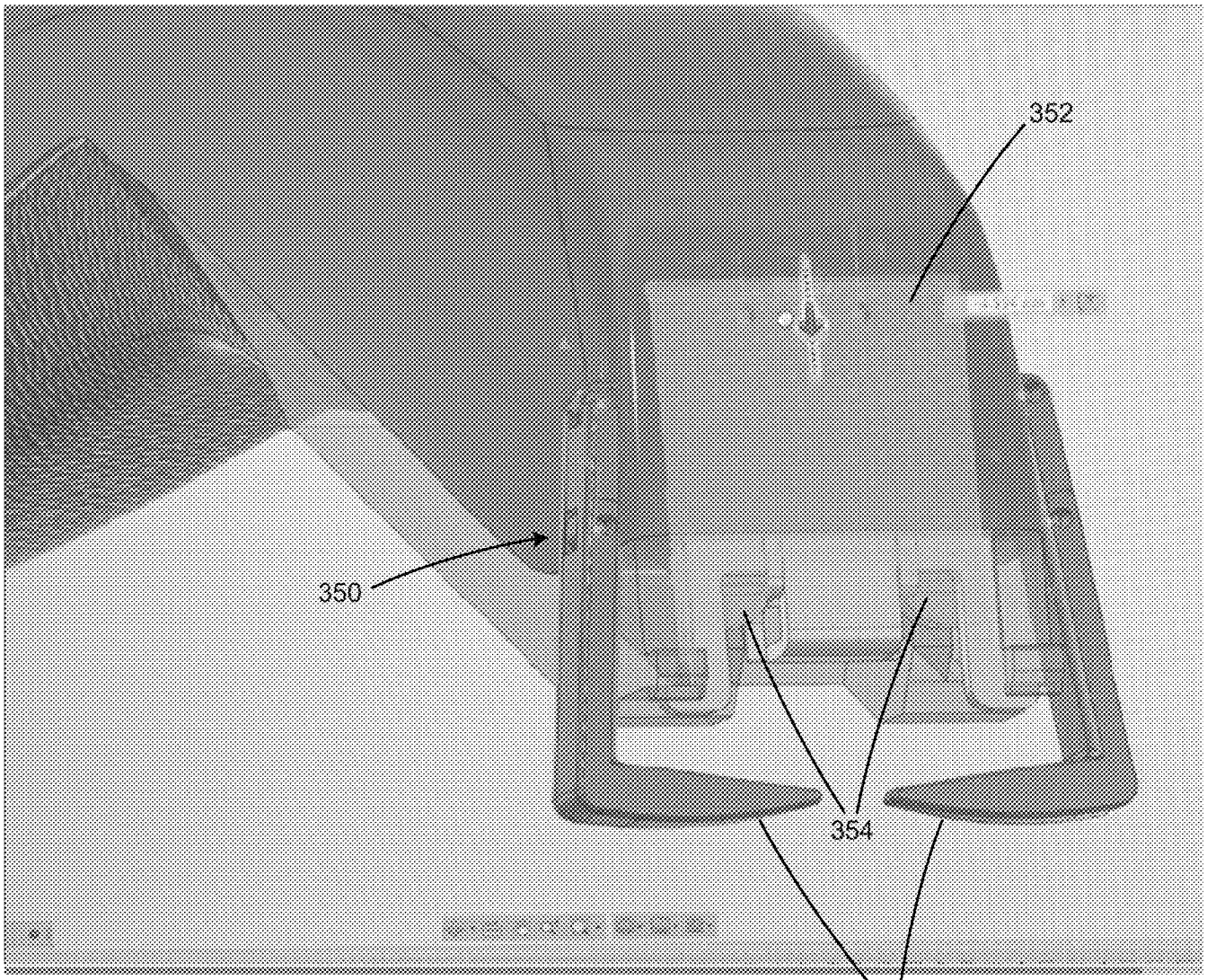
Figure 12G:
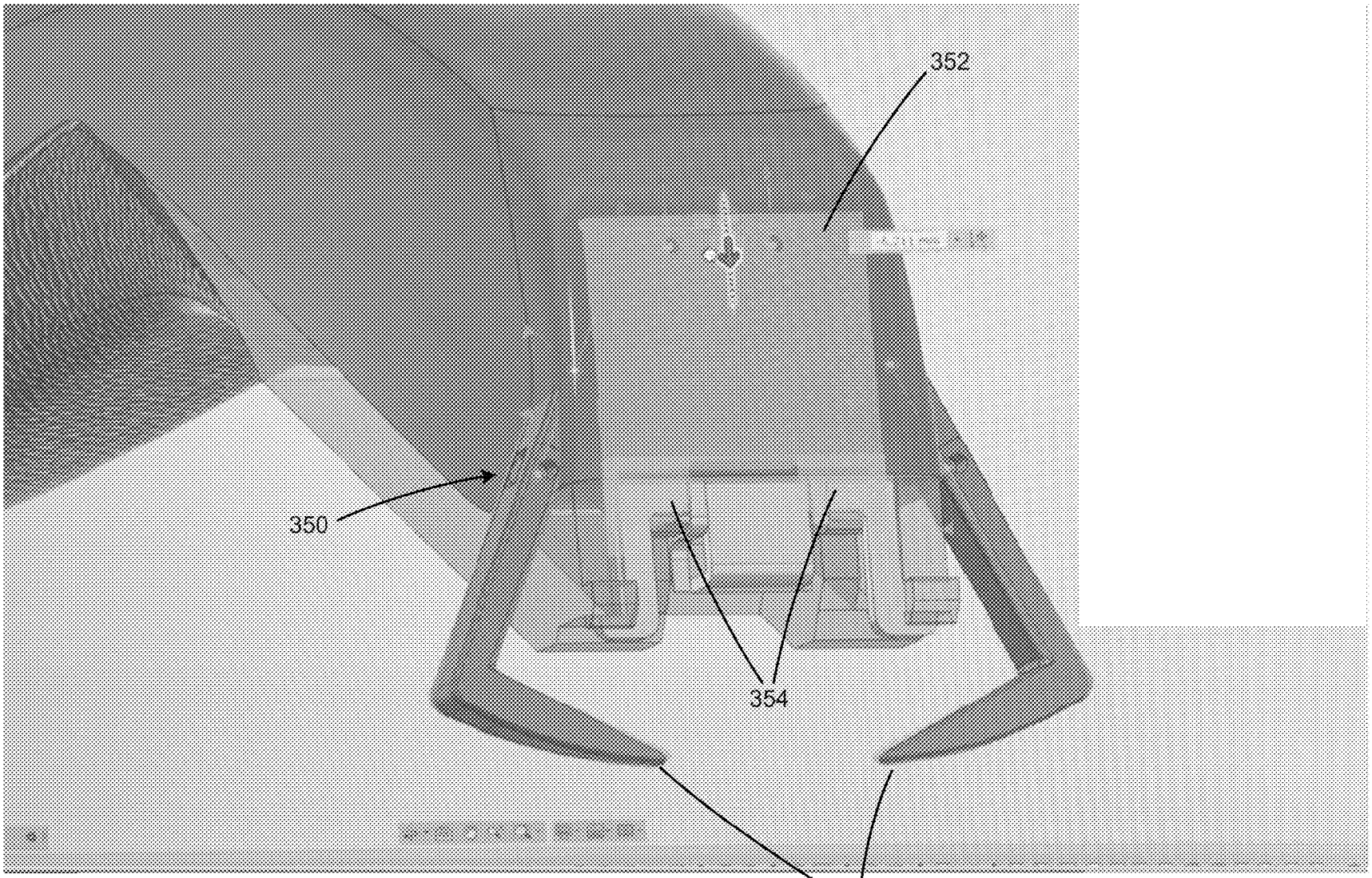

FIGS. 12B-12E illustrate further downward motion of the driver plate 352, causing the safety feet 302 to come together. In actual operation, a fastener is simultaneously crimped to attach a hair extension to the recipient's hair. FIGS. 12F and 12G illustrate that after crimping a fastener, the driver plate moves up, and the safety shields move back to the original quiescent position.

As will be understood by those familiar with the art, the invention may be embodied in other specific forms without departing from the spirit or essential characteristics thereof. Likewise, the particular naming and division of the portions, components, functions, procedures, actions, features, attributes, methodologies and other aspects are not mandatory, and the mechanisms that implement the invention or its features may have different names, divisions and/or formats.

Accordingly, the disclosure of the present invention is intended to be illustrative, but not limiting, of the scope of the invention, which is set forth in the following claims.

What is claimed is:

1. An apparatus for attaching a hair extension to a recipient's hair without injuring the recipient's scalp, the apparatus comprising:

a handheld tool having a first hand member and a second hand member, wherein the first and second hand members are mechanically coupled to each other and the first hand member is user moveable in relation to the second hand member;

a fastening mechanism coupled to the first hand member, wherein the fastening mechanism is configured to crimp a pliable material to form a fastener that attaches the hair extension to the recipient's hair; and a shield mechanism, distinct from the fastening mechanism, mechanically coupled to the first hand member, wherein the shield mechanism includes safety feet having first and second positions, the shield mechanism is in the first position when the apparatus is in a mechanically biased quiescent position, and the shield mechanism is in a second position when the fastening mechanism is crimping the fastener, wherein in the second position the safety feet are configured to be interposed between the recipient's scalp and a cornrow of the recipient's hair, and wherein the safety feet move from the first position to the second position as the fastener is being crimped.

2. The apparatus of claim 1, wherein the fastening mechanism includes a stapling mechanism and the fastener is a staple.

3. The apparatus of claim 1, wherein:

user manipulation of the hand members causes the shield mechanism to move from the first position to the second position, overcoming mechanical bias, and the user manipulation also causes the fastening mechanism to crimp the fastener; and user release of the hand members causes the shield mechanism to return to the first position under influence of the mechanical bias.

4. The apparatus of claim 3, wherein user manipulation of the hand members includes squeezing the hand members together.

5. The apparatus of claim 1, wherein the shield mechanism includes spacers in a fixed position on the first hand member of the apparatus, wherein the spacers are positioned such that the spacers maintain a predetermined distance between the fastener and the recipient's scalp.

6. The apparatus of claim 1, wherein, in the second position, the safety feet are configured to be positioned between the recipient's scalp and an anchoring structure comprising a cornrow of the recipient's hair.

7. The apparatus of claim 1, further comprising a spring member coupled to the hand members for spring-loading the hand members to the mechanically biased quiescent position in which the shield mechanism is in the first position.

* * * * *